US011705144B2

(12) United States Patent
Mindlin et al.

(10) Patent No.: US 11,705,144 B2
(45) **Date of Patent: *Jul. 18, 2023**

(54) METHODS AND SYSTEMS FOR ENCODING FREQUENCY-DOMAIN DATA

(71) Applicant: Verizon Patent and Licensing Inc., Basking Ridge, NJ (US)

(72) Inventors: Samuel Charles Mindlin, Brooklyn, NY (US); Mohammad Raheel Khalid, Budd Lake, NJ (US); Kunal Jathal, Los Angeles, CA (US)

(73) Assignee: Verizon Patent and Licensing Inc., Basking Ridge, NJ (US)

( * ) Notice: Subject to any disclaimer, the term of this patent is extended or adjusted under 35 U.S.C. 154(b) by 221 days.

This patent is subject to a terminal disclaimer.

(21) Appl. No.: 17/245,798

(22) Filed: Apr. 30, 2021

(65) Prior Publication Data

US 2021/0249025 A1 Aug. 12, 2021

Related U.S. Application Data

(63) Continuation of application No. 16/427,635, filed on May 31, 2019, now Pat. No. 11,024,322.

(51) Int. Cl.

| | |
|---|---|
| ***G10L 19/022*** | (2013.01) |
| ***G10L 19/00*** | (2013.01) |
| ***G10L 19/008*** | (2013.01) |

(52) U.S. Cl.
CPC ..... *G10L 19/022* (2013.01); *G10L 19/008* (2013.01); *G10L 19/0017* (2013.01)

(58) Field of Classification Search
None
See application file for complete search history.

(56) References Cited

U.S. PATENT DOCUMENTS

| | | | | |
|---|---|---|---|---|
| 11,024,322 | B2 * | 6/2021 | Mindlin | G10L 19/032 |
| 2009/0170435 | A1 | 7/2009 | Bush | |
| 2012/0265540 | A1 * | 10/2012 | Fuchs | G10L 19/008 704/500 |
| 2020/0118537 | A1 | 4/2020 | Zhao et al. | |

* cited by examiner

*Primary Examiner* — Stella L. Woo

(57) ABSTRACT

An illustrative frequency-domain encoder system transforms time-domain data representative of a content instance into frequency-domain data representative of the content instance. The frequency-domain data includes a plurality of complex coefficients each representing different frequency components of a plurality of frequency components incorporated by the content instance. The frequency-domain encoder system generates a frequency-domain data container that includes the complex coefficients of the frequency-domain data and metadata descriptive of the frequency-domain data. Additionally, within the frequency-domain data container, the frequency-domain encoder system integrates the complex coefficients of the frequency-domain data with timing data representative of a time-dependent feature of the content instance. Corresponding systems and methods are also disclosed.

20 Claims, 9 Drawing Sheets

METHODS AND SYSTEMS FOR ENCODING FREQUENCY-DOMAIN DATA

RELATED APPLICATIONS

This application is a continuation application of U.S. patent application Ser. No. 16/427,635, filed May 31, 2019, and entitled "Methods and Systems for Encoding Frequency-Domain Data," which is hereby incorporated by reference in its entirety.

BACKGROUND INFORMATION

It is useful for various use cases and applications to perform signal processing, mathematical analysis, and/or other processing functions on data describing various phenomena with respect to time. Such data may be referred to as time-domain data and may include content instances such as audio instances (audio files, audio streams, etc.) and/or other physical or abstract phenomena (e.g., time series of economic data, environmental data, etc.). Analogously, certain content instances such as images (e.g., color photographs, depth images, etc.), video instances (video files, video streams, etc.), and so forth, may be described with respect to spatial position (e.g., pixel position in the image, etc.) in addition to or as an alternative to being described with respect to time.

While time-domain data may be processed directly, certain processing functions may be made possible or more convenient by transforming the time-domain data into frequency-domain data that describes the same phenomena or content with respect to frequency, rather than with respect to time (or spatial position). Unfortunately, however, transforming time-domain data into frequency-domain data requires considerable processing time and resources, thereby making it inefficient, impractical, or even infeasible to process data in the frequency domain for certain applications.

BRIEF DESCRIPTION OF THE DRAWINGS

The accompanying drawings illustrate various embodiments and are a part of the specification. The illustrated embodiments are merely examples and do not limit the scope of the disclosure. Throughout the drawings, identical or similar reference numbers designate identical or similar elements.

DETAILED DESCRIPTION OF PREFERRED EMBODIMENTS

Figure 1:
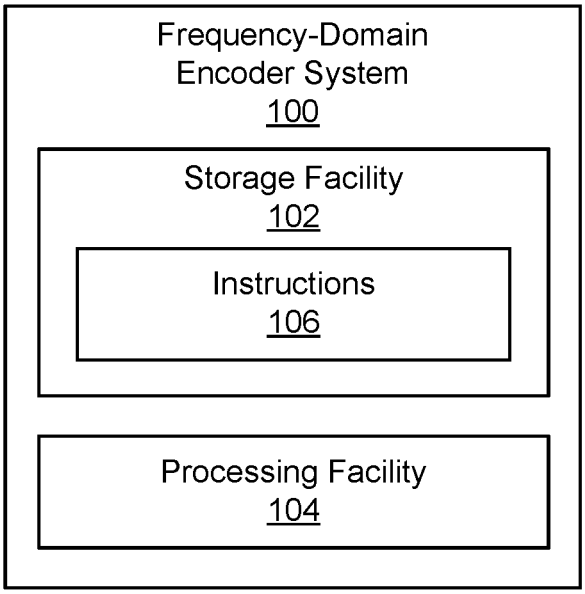
FIG. 1 illustrates an exemplary frequency-domain encoder system for encoding frequency-domain data according to principles described herein.

Methods and systems for encoding frequency-domain data are described herein. Various types of data and signal processing have conventionally been done in the frequency domain by transforming to and from the frequency domain in an on-demand manner. For example, data representative of a particular signal or content instance is conventionally generated, stored, and communicated in the time domain, and transformations to and from the frequency domain are performed immediately before and after signal processing operations that are configured to be performed on frequency-domain data. As will be described and made apparent herein, significant efficiency gains and performance improvements may result when systems performing such frequency-domain operations have access to frequency-domain data that is encoded in a known form (e.g., as a file, stream, or other frequency-domain data container associated with a predefined data container format) and thus does not need to be transformed from the time-domain before being used. Accordingly, methods and systems described herein relate to encoding complex coefficients of frequency-domain data, together with metadata descriptive of the frequency-domain data, in various types of frequency-domain data containers to provide certain advantages and benefits described herein.

One example of a frequency-domain encoder system configured to encode frequency-domain data into a frequency-domain data container will now be described. The frequency-domain encoder system may access a set of encoder parameters, and may also access time-domain data representative of a content instance. The content instance may include any type of content such as audio content, image content, video content, or other types of content (e.g., content describing physical or abstract phenomena such as economic phenomena, environmental phenomena, etc.) that may be represented by time-domain data. As used herein, time-domain data may refer to various types of data describing content in a direct, non-transformed manner such as in the time domain, in the spatial domain, or the like, depending on what type of content instance is described. For example, while data representative of an image may properly be referred to as spatial-domain data, this and other similar types of data may be analogized to the time domain and, as such, will be understood to be included in "time-domain data" as that term is used herein. The encoder parameters may indicate details about the time-domain data itself (e.g., the format of the time-domain data, etc.) and/or information about the content instance that the time-domain data represents. Additionally or alternatively, the encoder parameters may indicate details about how the time-domain data is to be transformed into frequency-domain data and/or about the form the frequency-domain data container is to take when generated.

In accordance with the set of encoder parameters that has been accessed, the frequency-domain encoder system may transform the time-domain data that has been accessed into frequency-domain data representative of the content instance. For example, the frequency-domain data may include a plurality of complex coefficients each representing different frequency components of a plurality of frequency components incorporated by the content instance. Also in accordance with the set of encoder parameters, the frequency-domain encoder system may generate a frequency-domain data container. For example, the frequency-domain data container may be a data file, a data stream, or another such data container that adheres to a predefined data container format. The frequency-domain data container generated by the frequency-domain encoder system may include (e.g., in the predefined data container format) the complex coefficients of the frequency-domain data, as well as other suitable data such as metadata descriptive of the frequency-domain data.

Methods and systems described herein for encoding frequency-domain data may provide various advantages and benefits. As one example that has been mentioned, for instance, methods and systems described herein may increase efficiency in situations where frequency-domain processing is performed. Transforming data from the time domain to the frequency domain involves relatively intensive processing and, as such, it is not desirable to perform such transformation operations redundantly or on a tighter timeline than necessary (e.g., on-demand or in a just-in-time manner when the data is available ahead of time), particularly for use cases that are latency sensitive. If an application requiring frequency-domain processing is executing on a system with relatively modest computing resources (e.g., the resources of a single mobile device), frequency-domain transformation operations may consume an inordinate amount of the limited computing resources, or may take too long (e.g., introducing an amount of latency that is prohibitive to other aspects of the application). Conversely, even if such an application is executing on a system with more ample computing resources (e.g., the resources of an Multi-Access Edge Compute ("MEC") server or the like), it would be desirable to minimize latency and superfluous computation by performing frequency domain transformation operations one time (e.g., a time prior to when the frequency-domain data is actually to be used) and one time only (e.g., rather than retransforming the data each and every time the frequency-domain data is to be used). The methods and systems described herein advantageously provide such efficiencies because time-domain data may be transformed to frequency-domain data at one time, prior to use, and stored in a frequency-domain data container for later use as may be appropriate in different applications and use cases.

Another exemplary advantage of the frequency-domain data encoding methods and systems described herein is the flexibility that different frequency-domain data containers may have to serve many different use cases. For example, as will be described in more detail below, the methods and systems described herein may be used to generate customized frequency-domain data containers that are tailored to particular use case scenarios by optimizing the container for various different priorities (e.g., container size, transmission latency, processing performance, robust or variable bitrate streaming, etc.).

Moreover, various general benefits of data encoding may apply to the methods and systems described herein for encoding frequency-domain data, just as they apply to other forms of data encoding. For example, as will be described in more detail below, encoding data as complex coefficients in the frequency domain, rather than magnitude values in the time domain, may allow for the data to be compressed, thereby making the data easier to store and/or communicate.

Various embodiments will now be described in more detail with reference to the figures. The disclosed systems and methods may provide one or more of the benefits mentioned above and/or various additional and/or alternative benefits that will be made apparent herein.

FIG. 1 illustrates an exemplary frequency-domain encoder system 100 ("system 100") for encoding frequency-domain data. Specifically, as shown, system 100 may include, without limitation, a storage facility 102 and a processing facility 104 selectively and communicatively coupled to one another. Facilities 102 and 104 may each include or be implemented by hardware and/or software components (e.g., processors, memories, communication interfaces, instructions stored in memory for execution by the processors, etc.). In some examples, facilities 102 and 104 may be distributed between multiple devices and/or multiple locations as may serve a particular implementation. Each of facilities 102 and 104 within system 100 will now be described in more detail.

Storage facility 102 may maintain (e.g., store) executable data used by processing facility 104 to perform any of the functionality described herein. For example, storage facility 102 may store instructions 106 that may be executed by processing facility 104. Instructions 106 may be executed by processing facility 104 to perform any of the functionality described herein, and may be implemented by any suitable application, software, code, and/or other executable data instance. Additionally, storage facility 102 may also maintain any other data accessed, managed, used, and/or transmitted by processing facility 104 in a particular implementation.

Processing facility 104 may be configured to perform (e.g., execute instructions 106 stored in storage facility 102 to perform) various functions associated with encoding frequency-domain data in the ways described herein. For example, processing facility 104 may be configured to access (e.g., receive, input, load, generate, etc.) a set of encoder parameters and time-domain data representative of a content instance. For instance, processing facility 104 may access any of the types of encoder parameters and/or time-domain data described herein or as may serve a particular implementation. Processing facility 104 may further be configured to transform, in accordance with the set of encoder parameters, the time-domain data into frequency-domain data representative of the content instance. The frequency-domain data may include, for example, a plurality of complex coefficients each representing different frequency components of a plurality of frequency components incorporated by the content instance. Also in accordance with the set of encoder parameters, processing facility 104 may generate a frequency-domain data container that includes, in a predefined data container format, the complex coefficients of the frequency-domain data. The frequency-domain data container may also include other data as may serve a particular implementation. For instance, the frequency-domain data container may include, together with the complex coefficients of the frequency-domain data, metadata descriptive of the frequency-domain data.

Figure 2:
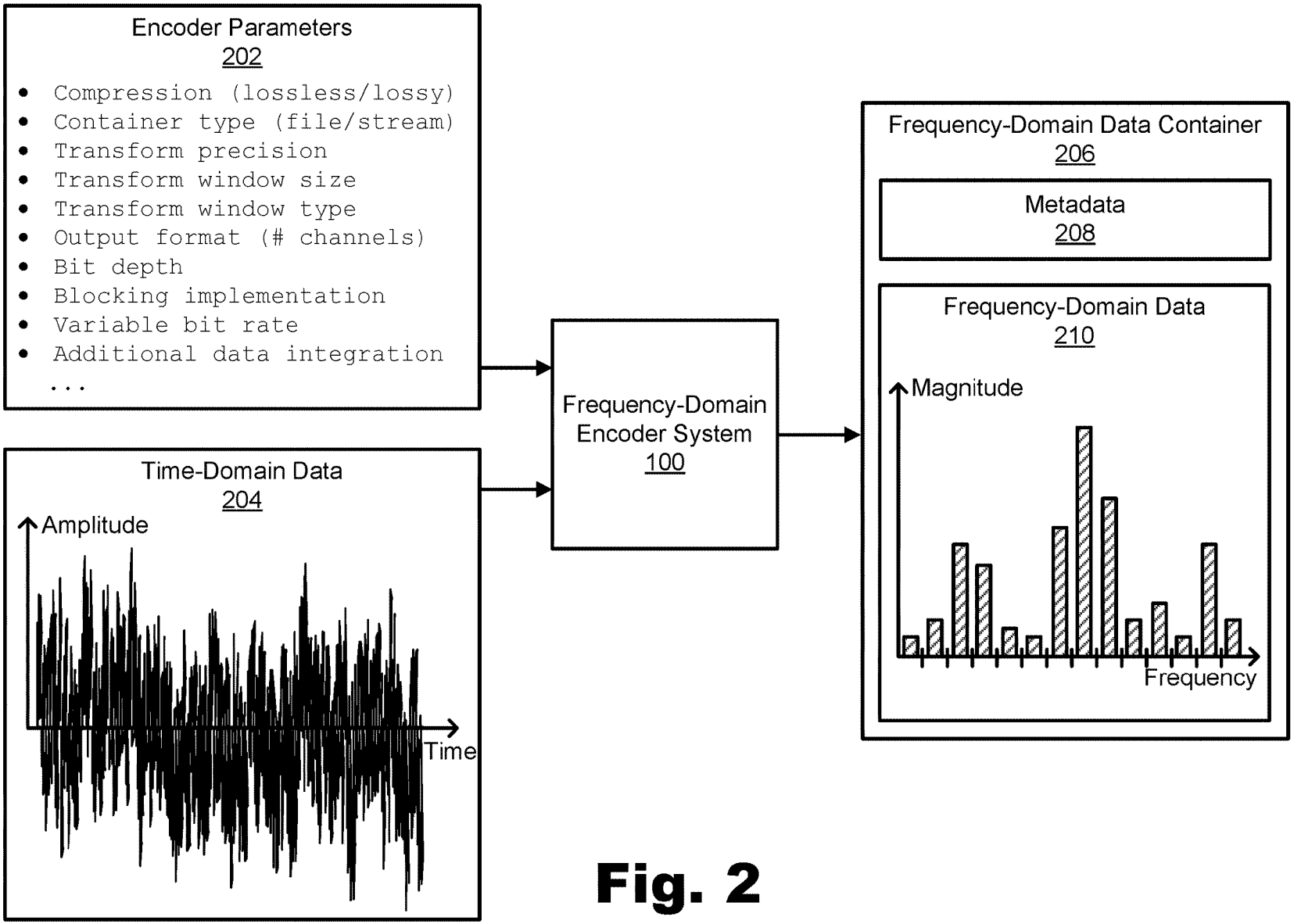
FIG. 2 illustrates exemplary aspects of input and output data of the frequency-domain encoder system of FIG. 1 according to principles described herein.

To illustrate the functions of system 100 that have been described, as well as other potential functions that system 100 may be configured to perform, FIG. 2 shows exemplary aspects of input and output data of system 100. Specifically, as shown, FIG. 2 shows that a set of encoder parameters 202 is accessed by system 100 as an input, an instance of time-domain data 204 is accessed by system 100 as an input, and a frequency-domain data container 206 is generated by system 100 as an output. As further shown, frequency-domain data container 206 is generated to include, in a predefined data container format, various types of data including metadata 208 and frequency-domain data 210. While FIG. 2 shows a few specific examples of data that may be input to and output from system 100, it will be understood that other types of data not explicitly shown in FIG. 2 may also be input to system 100 and/or output from system 100 as may serve a particular implementation. Each type of input and output data shown in FIG. 2 will now be described in more detail.

Encoder parameters 202 may include any of the types of encoder parameters that have been described to indicate any suitable information such as details about time-domain data 204, parameters for generating frequency-domain data container 206 (and metadata 208 and frequency-domain data 210 included therein), or any other such data as may serve a particular implementation. As shown in FIG. 2, for example, encoder parameters 202 may include parameters to indicate how lossy or lossless a selected compression algorithm employed by system 100 is to be. For instance, if data fidelity (e.g., sound quality, etc.) is a priority in a particular implementation, it may be appropriate for encoder parameters 202 to indicate that a lossless compression algorithm (or no compression algorithm) is to be employed when packaging up frequency-domain data 210. In contrast, if reducing the size of frequency-domain data container 206 is a higher priority than maintaining data fidelity in a certain implementation (e.g., to make frequency-domain data container 206 easier to transmit, easier to store, etc.), it may be appropriate for encoder parameters 202 to indicate that a lossy compression algorithm (i.e., one that will compress the data to a smaller size than may be possible with a lossless compression algorithm) is to be employed.

In some examples, encoder parameters 202 may directly designate aspects of the transformation of time-domain data 204 and the generation of frequency-domain data container 206 that are to be prioritized, and specific parameters may be derived therefrom. For example, an encoder parameter 202 may indicate that reducing storage size of the frequency-domain data container is to be prioritized and system 100 may therefore determine specific parameters for a compression algorithm that is to be employed (e.g., a lossy compression algorithm in this example), a data precision that is to be used (e.g., relatively low precision in this example), and so forth. In other examples, encoder parameters 202 may directly indicate how the transformation of time-domain data 204 and the generation of frequency-domain data container 206 are to be performed, and the priorities may thereby be implemented inherently. For example, an encoder parameter 202 that designates a compression algorithm with a particularly short decode time may inherently produce an implementation that prioritizes low-latency time-to-frequency-domain transformation and frequency-domain data container generation. Other priorities may be explicitly or implicitly prioritized as well, such as a robust data streaming priority, a variable bitrate streaming priority, a priority to include additional payload data along with the frequency-domain data, or any other priority as may serve a particular implementation.

As another example of how encoder parameters 202 may control how the frequency-domain data container is generated and the time-to-frequency-domain transformation is performed, a parameter may be included in encoder parameters 202 that indicates the type of frequency-domain data container 206 that is to be generated. For example, as will be illustrated in more detail below, this encoder parameter may dictate whether frequency-domain data container 206 is generated as a frequency-domain data file, as a frequency-domain data stream, or as another suitable type of frequency-domain data container.

Other exemplary encoder parameters 202 may define how system 100 is to perform the transforming of time-domain data 204 into frequency-domain data 210. In some implementations, the transforming of time-domain data 204 into frequency-domain data 210 may be performed using a fast Fourier transform ("FFT") technique based on one or more FFT parameters included in encoder parameters 202. Accordingly, one of encoder parameters 202 may indicate the precision (e.g., 16-bit precision, 32-bit precision, 64-bit precision, etc.) of the FFT. Another of encoder parameters 202 may indicate a window size for the FFT. Another of encoder parameters 202 may indicate a window type (e.g., Blackman, Hann, Hamming, Gaussian, Tukey, etc.) for the FFT. Other encoder parameters 202 may indicate other details for the FFT or for another type of transform technique employed by system 100 as may serve a particular implementation.

As further shown in FIG. 2, certain encoder parameters 202 may also define other aspects of the frequency-domain data container 206 that is to be output, including defining various aspects of metadata 208 and frequency-domain data 210 included therein. For instance, one of encoder parameters 202 may indicate an output format, including how many channels is to be included in the output (e.g., a monaural format with one channel, a stereo format with two channels, 5.1 surround sound format with six channels, a 7.1 surround sound format with eight channels, an Ambisonic format with an appropriate number of channels based on which order of Ambisonic format is used, etc.). As another example, encoder parameters 202 may indicate a bit depth for the frequency-domain data 210 (or details about various bit depths that are to be supported for variable bitrate implementations), blocking details for how frequency-domain data 210 is to be formatted and (in certain implementations as will be described below) integrated with other types of data, and so forth. For implementations in which additional types of data (e.g., timing data, phoneme data, etc.) are to be integrated and intermixed with frequency-domain data 210 in frequency-domain data container 206, this additional data may also be included in the encoder parameters 202 that are accessed by system 100.

Time-domain data 204 may include any type of time-domain data described herein or as may serve a particular implementation. Time-domain data may refer to data that describes a phenomenon such as sound with respect to time. Accordingly, as shown in FIG. 2, time-domain data 204 depicts how an amplitude (e.g., a sound pressure amplitude or the like) represented by the vertical axis (the y axis) changes with respect to time represented by the horizontal axis (the x axis). Additionally, as mentioned above, time-domain data may also refer to non-audio data that would also benefit from frequency-domain analyses (e.g., relating to convolution neural nets, economic or environmental modeling, etc.). In some examples, such non-audio time-domain data may include visual data (e.g., for a still or video image), statistical data, economic data, environmental data, or the like, which may be represented with respect to time or other suitable dimensions such as spatial position. Accordingly, while time-domain data 204 depicts amplitude with respect to time, it will be understood that certain implementations may depict amplitude or another suitable characteristic with respect to a spatial position or another suitable dimension (other than frequency).

System 100 may access time-domain data 204 in any suitable manner. For example, system 100 may load time-domain data 204 from storage (e.g., from storage facility 102), receive time-domain data 204 in a transmission from another device or system (e.g., a content creation system, a microphone, etc.), generate (e.g., synthesize, mix, create, etc.) time-domain data 204, or otherwise access time-domain data 204. In certain examples, time-domain data 204 may be encoded when accessed by system 100 and, as such, may require decoding before the time-domain data can be transformed or otherwise used. For instance, the time-domain data may be encoded in one particular format (e.g., MP3, MP4, Ogg, etc.) and may need to be decoded to a raw format (e.g., PCM, WAV, etc.) prior to being transformed into the frequency domain. Accordingly, system 100 may include one or more decoding facilities (e.g., hardware and/or software) associated with one or more encoding formats, and may be configured to perform decoding operations prior to beginning operations to transform time-domain data 204 into frequency-domain data 210.

In some examples, time-domain data 204 may be prerecorded or pre-generated and stored to disk. For example, a video game or extended reality world may be associated with various sound effects and dialog spoken by non-player characters that may be predefined and stored in files associated with the video game or extended reality world. In other examples, time-domain data 204 may be generated, accessed, and processed in real time or near real time. For example, time-domain data 204 may be representative of live-captured audio or video content (e.g., audio being processed as it is spoken into a microphone, such as by players chatting while sharing a video game or extended reality experience).

In certain implementations and scenarios, time-domain data 204 may be stored in a file that system 100 may access by completely loading the file from storage into memory prior to beginning operations to transform the time-domain data. For example, this may be the case when time-domain data 204 is prerecorded or pre-generated and stored to disk, as described above. In these implementations and scenarios, system 100 may treat time-domain data 204 as a single unit, decoding and transforming the data in a single pass.

In other implementations and/or scenarios, time-domain data 204 may not be consolidated into a single file (e.g., because the data represents content that is being created in real time), and system 100 may thus access this time-domain data 204 by streaming it piece by piece (e.g., packet by packet, etc.) from a system or device that is creating or streaming the time-domain data. For example, this may be the case when time-domain data 204 is being generated in real time. In these implementations and scenarios, system 100 may decode and transform time-domain data 204 piece by piece, rather than in a single pass.

Frequency-domain data container 206 may be implemented as any suitable type of data container as may serve a particular implementation. For example, as will be described in more detail below, frequency-domain data container 206 may be implemented as a frequency-domain data file, a frequency-domain data stream, or another suitable container. In any case, system 100 may generate frequency-domain data container 206 in accordance with a predefined data container format, and, as such, frequency-domain data container 206 may follow any conventions or rules (e.g., being named with a certain file extension, having metadata formatted in a certain way, etc.) associated with that predefined data container format.

To this end, system 100 may perform various operations, in addition to the time-to-frequency-domain transforming operations, to properly generate frequency-domain data container 206. For example, system 100 may access and analyze encoder parameters 202 to determine how time-domain data 204 is to be pre-processed and/or otherwise prepared for transformation to the frequency domain. For instance, system 100 may determine that time-domain data 204 is encoded and needs to be decoded to a raw format prior to transformation. As another example, system 100 may determine that zero padding is needed to cause the number of time-domain samples to be processed to comport with particular requirements or parameters of the frequency transformation algorithm (e.g., to increase the number of time-domain samples to a power of two in the case of an FFT algorithm, etc.), and may thus provide such zero padding as data is packaged for frequency-domain data container 206. System 100 may further package up and pass along, within metadata 208, various information derived from encoder parameters 202 that may be important for a recipient of frequency-domain data container 206.

For example, system 100 may generate metadata 208, in accordance with the predefined data container format, to include metadata describing frequency-domain data container 206 and/or frequency-domain data 210 in any way. For example, to describe frequency-domain data container 206, metadata 208 may include, without limitation, blocking data indicating the size and types of data blocks that are included within a payload of frequency-domain data container 206, an MD5 signature (e.g., to prevent transmission errors), metadata representative of a compression algorithm used to compress the payload, metadata describing a variable bitrate implementation being used, metadata representative of other aspects of the predefined data container format (e.g., data rate, seek points, frame offsets, placeholders, etc.), and/or any other application-specific metadata as may serve a particular implementation. Moreover, metadata 208 may include additional metadata to describe frequency-domain data 210 such as, without limitation, a sample rate, a bit depth, a sample size, a number of samples, a number of channels, a channel layout, an endianness used to represent the data, an FFT size (e.g., a number of frequency components), an FFT window type, a maximum and/or minimum block size, and any other data representative of characteristics of frequency-domain data 210. Metadata 208 may also represent data such as the bit depth of original time-domain data 204 to indicate the original dynamic range of the time-domain data (e.g., 16 bits, 32 bits, 64 bits, etc.).

Frequency-domain data 210 may include frequency-domain data generated by transforming any of the types of time-domain data described herein. Frequency-domain data may refer to data that describes a phenomenon (e.g., sound, color, statistical phenomena, etc.) with respect to frequency, rather than time or space. Accordingly, as shown in FIG. 2, frequency-domain data 210 depicts how signal magnitude (represented by the vertical axis) and phase (not explicitly shown in FIG. 2) vary with respect to frequency (represented along the horizontal axis). Frequency-domain data 210 may be composed of a plurality of complex coefficients that each represent a different frequency component of a plurality of frequency components incorporated by whatever content instance (e.g., sound, image, etc.) that time-domain data 204 represents. For example, if time-domain data 204 represents a sound, the sound signal may be divided up into some number of components associated with different frequencies or frequency ranges. For each such frequency, frequency-domain data 210 may include complex coefficients associated with a complex number whose vector length represents a magnitude of the frequency component, and whose vector angle represents a phase of the frequency component.

As mentioned above, system 100 may generate frequency-domain data 210 by using an FFT technique or any other suitable transform technique to process time-domain data 204. As such transformation operations are performed, it will be understood that various encoder parameters 202 (e.g., relating to FFT precision, FFT size, FFT window type, etc.) may be taken into account so that the complex coefficients generated for each of the frequency components of the original content instance are transformed in accordance with the appropriate encoder parameters 202. In some examples, FFT calculations may be performed by parallel hardware resources (e.g., parallel graphics processing units ("GPUs"), etc.) such as may be found in a MEC or other network-edge-deployed server.

As described above, one advantage that arises from system 100 and other systems and methods described herein is that frequency-domain data containers generated by the systems and methods may be stored for later use, communicated in various ways (e.g., transmitted over a network, etc.), or otherwise used in ways that are not feasible when frequency-domain data is generated in the conventional manner in which the frequency-domain data is temporarily stored in memory while being used and then discarded when frequency-domain processing is complete. To this end, frequency-domain data container 206 may take any suitable form and may be associated with any suitable predefined data container format.

Figure 3A:
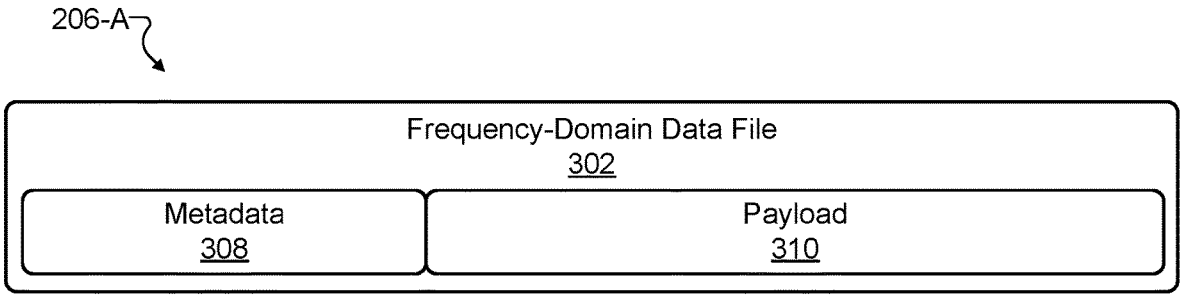
FIGS. 3A and 3B illustrate exemplary frequency-domain data containers that may be generated by the frequency-domain encoder system of FIG. 1 according to principles described herein.
Figure 3B:
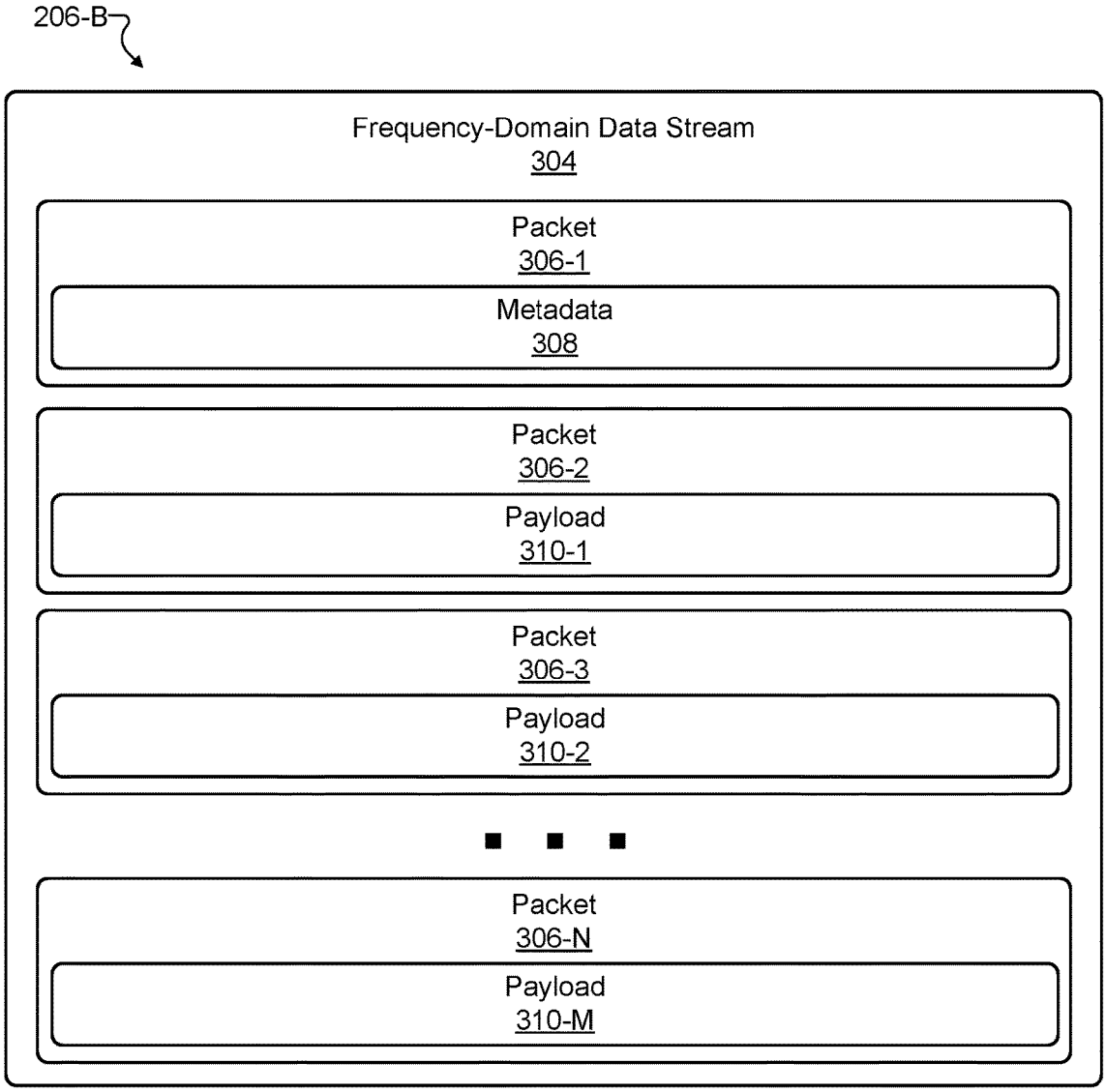

To illustrate a few specific examples, FIGS. 3A-3B illustrate, respectively, exemplary implementations 206-A and 206-B of frequency-domain data container 206 that may be generated by system 100. Specifically, as shown, implementation 206-A of frequency-domain data container 206 is implemented as a frequency-domain data file 302, while implementation 206-B of frequency-domain data container 206 is implemented as a frequency-domain data stream 304 that is packetized into a plurality of packets 306 (e.g., packets 306-1 through 306-N).

As shown, both implementations 206-A and 206-B have certain commonalities in the data that they contain. For example, a predefined data container format that defines either frequency-domain data file 302 or frequency-domain data stream 304 may designate both 1) a metadata portion of the frequency-domain data container to contain, formatted in a plurality of predetermined metadata fields, the metadata descriptive of the frequency-domain data; and 2) a payload portion of the frequency-domain data container to contain, formatted in a predetermined blocking format, the complex coefficients of the frequency-domain data. In accordance with either a file-based or stream-based predefined data container format, frequency-domain data (and other types of data in certain implementations) may be containerized and structured so as to facilitate storage, transmission, processing, or other anticipated uses of the data.

Implementations 206-A and 206-B also illustrate that different types of frequency-domain data containers have significant differences. For example, one difference between implementations 206-A and 206-B is that, because frequency-domain data file 302 is a standalone file, the metadata portion (metadata 308) and the payload portion (payload 310) of implementation 206-A may each include any amount of data as may be allowed by a predefined file format (e.g., a size dependent on the amount of original content). In contrast, because frequency-domain data stream 304 is packetized for transmission over a network, the metadata portion (metadata 308) and payload portion (payload 310) of frequency-domain data stream 304 may each be spread across one or more packets 306. For example, metadata 308 is shown to be included in a first packet 306-1, while payload 310 is split into parts 310 (e.g., parts 310-1 through 310-M, where M is the number of parts payload 310 is split into) that are spread across packets 306-1 through 306-N (where N is the number of total packets in frequency-domain data stream 304 and is equal to M+1 in this example since payload 310 fills all of packets 306 except packet 306-1). Each packet 306 may include packet header data to facilitate transmission (e.g., to guarantee delivery, to correct transmission errors, etc.).

Metadata 308 may correspond to metadata 208, described above in FIG. 2, and may include any of the data described in relation to metadata 208. In frequency-domain data file 302, metadata 308 may be included within a file header or the like, while, in frequency-domain data stream 304, metadata 308 may be included within one or more preliminary packets (e.g., such as packet 306-1, as shown), and within additional packets later in frequency-domain data stream 304 as updates or changes to fields of metadata 308 may occur over time. While each packet 306 is shown to only include metadata or payload data in FIG. 3B, it will be understood that, in certain examples, packets 306 may include both metadata (e.g., all or part of metadata 308) and payload data (e.g., all or part of payload 310).

Figure 4A:
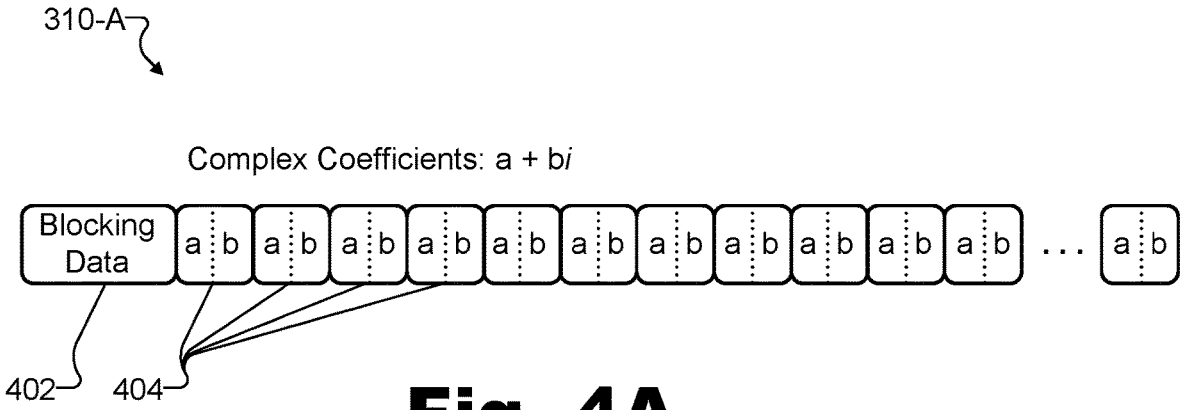
FIGS. 4A-4C illustrate exemplary aspects of exemplary payload data that may be included within the frequency-domain data containers of FIGS. 3A and 3B according to principles described herein.
Figure 4B:
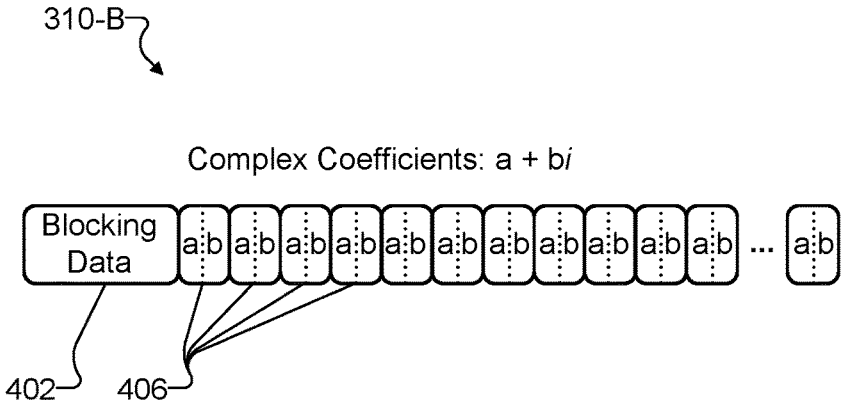
Figure 4C:
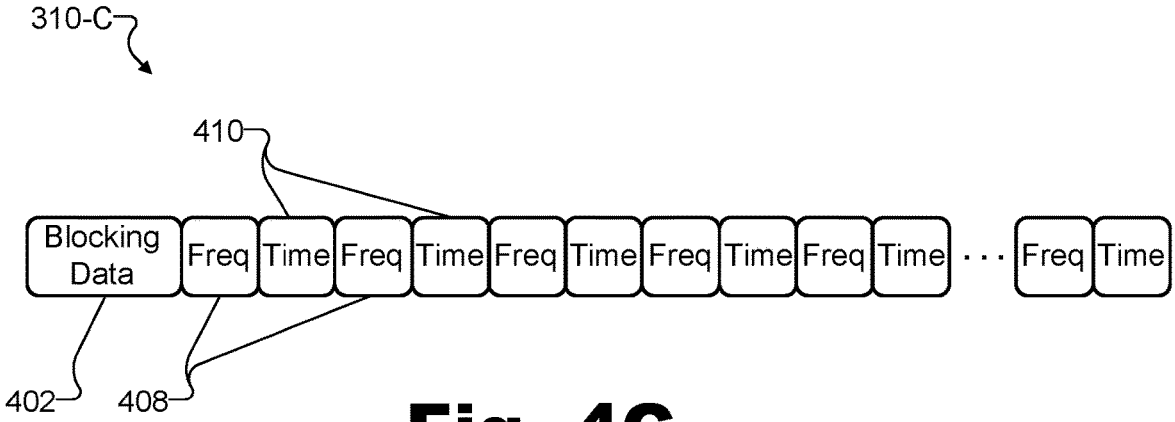

Payload 310 may correspond to frequency-domain data 210, described above in FIG. 2, and may include frequency-domain data such as the complex coefficients described above, as well as other types of payload data as may serve a particular implementation. To illustrate, FIGS. 4A-4C show exemplary aspects of exemplary payload data that may be included within any of the frequency-domain data containers 206 described herein (including frequency-domain data file 302 and frequency-domain data stream 304). Specifically, FIG. 4A illustrates a payload 310-A that includes blocking data 402 and a plurality of complex coefficients 404, FIG. 4B illustrates a payload 310-B that includes blocking data 402 and a plurality of compressed complex coefficients 406, and FIG. 4C illustrates a payload 310-C that includes blocking data 402 and a plurality of both frequency data blocks 408 and time data blocks 410. Each of the different payloads 310-A through 310-C may be useful in different use cases, and will be understood to be further customizable to those use cases as may serve a particular implementation.

As shown, each of payloads 310 begin with blocking data 402. Blocking data 402 may include any data (e.g., metadata, etc.) that may indicate the start of the payload and/or the contents included therein. For example, blocking data 402 may include data representative of a synchronization code, a frame header, compression information (e.g., prediction data, etc.), zero padding, data indicative of the amount of data to follow (e.g., the number of complex coefficients, the number of bytes or words in the rest of the payload, etc.), or any other payload-related information as may serve a particular implementation. In some examples, additional blocking data such as blocking data 402 may be included at other points within a particular payload 310 (e.g., at one or more places in the middle of the payload, at the end of the payload, etc.). Such additional blocking data may include a frame footer or any of the other blocking data described above.

Complex coefficients 404 included within payload 310-A are shown to each include a real coefficient "a" and an imaginary coefficient "b" such that complex coefficients 404 represent a plurality of complex numbers each having the form "a+b i" (where "i" is the imaginary unit, the square root of −1). As described above, each such complex number may correspond to both a magnitude representing the magnitude of a particular frequency component and an angle representing the phase of the particular frequency component.

As shown, payload 310-B is similar to payload 310-A, but complex coefficients 406 are shown to be narrower than complex coefficients 404 to illustrate that complex coefficients 406 are compressed to be represented using less data than complex coefficients 404. Accordingly, these complex coefficients may be referred to as compressed complex coefficients 406. Once decoded and decompressed, complex coefficients 406 may each take the same form as complex coefficients 404.

In examples employing a compressed payload 310 such as payload 310-B, the generating of frequency-domain data container 206 may include selecting a compression algorithm from a set of compression algorithms that are available. For example, system 100 may select an appropriate compression algorithm based on the set of encoder parameters 202. Any suitable compression algorithms may be made available to be selected from as may serve a particular implementation. For example, the available compression algorithms may include lossy and/or lossless compression algorithms such as an FPC compression algorithm, a DFCM compression algorithm, a GFC compression algorithm, a Rice compression algorithm, a Huffman compression algorithm, or the like that will enable different priorities to be emphasized in any of the ways described herein.

System 100 may generate compressed complex coefficients 406 by compressing, using the selected compression algorithm, complex coefficients that have been derived for frequency-domain data 210 (e.g., complex coefficients 404). For instance, a compression operation may be performed by system 100 on complex coefficients generated by an FFT technique as part of the generating of frequency-domain data 210 and payload 310. System 100 may also integrate compressed complex coefficients 406 into frequency-domain data container 206 in accordance with the predefined data container format. For example, as shown in FIG. 4B, compressed complex coefficients 406 may be included in a payload 310 such as payload 310-B.

In some examples, system 100 may include blocking and serialization operations in the generating of the frequency-domain data container such that frequency-domain data 210 may be packaged together with other useful types of data. As one example, system 100 may alternate a plurality of payload segments each including a different portion of the complex coefficients (e.g., complex coefficients 404 or compressed complex coefficients 406) of frequency-domain data 210, with a plurality of payload segments each including a portion of time-domain data 204 that corresponds to one of the different portions of the complex coefficients of the frequency-domain data. Specifically, for instance, for each of a plurality of data portions of a content instance (e.g., each of a plurality of one-second portions of an audio file, etc.) a block of frequency-domain data 210 representing the data portion (e.g., a plurality of compressed or uncompressed complex coefficients representative of the data portion) may be integrated or interleaved with a block of time-domain data 204 representing the same data portion. By integrating the time-domain data together with the frequency-domain data in a unified data container in this way, the data container may be used to perform digital signal processing in either the time-domain or the frequency-domain, which may be convenient and advantageous in certain applications and use cases.

To illustrate, FIG. 4C shows payload 310-C to include a plurality of frequency-domain data blocks 408 integrated with (i.e., serialized with or interleaved with) a plurality of time-domain data blocks 410. Each pair of data blocks 408 and 410 (i.e., the first frequency-domain data block 408 and the first time-domain data block 410, the second frequency-domain data block 408 and the second time-domain data block 410, etc.) may represent a particular data portion of the content instance represented by time-domain data 204 and frequency-domain data 210. For example, if the content instance is an audio file, each pair of data blocks in payload 310-C may represent a portion (e.g., a 10 millisecond portion, a 100 millisecond portion, etc.) of the audio file in both the frequency-domain (i.e., frequency-domain data block 408) and the time-domain (i.e., time-domain data block 410). In these examples, blocking data 402 may indicate details of how many of each type of data block are present, how long each data block is, and so forth.

In the same or other implementations, other types of data besides time-domain data 204 representative of the same content instance may also or alternatively be integrated with frequency-domain data 210 in a payload 310 of a frequency-domain data container 206. For example, system 100 may integrate, with complex coefficients (e.g., complex coefficients 404 or compressed complex coefficients 406) of frequency-domain data 210, timing data representative of a time-dependent feature of the content instance. For example, time codes (SMPTE time codes, etc.), animation data (e.g., phoneme data, viseme data, etc.), motion capture data, video or multimedia data, data representing associated graphics assets, and/or any other suitable type of data as may serve a particular implementation may be integrated together with the frequency-domain data 210 in a particular payload 310 in the same way as the time-domain data 204 described above and illustrated in FIG. 4C. Because time-domain audio data is commonly relied on to carry timing information needed for audiovisual data, it may be convenient and advantageous in various applications and use cases to integrate timing data and/or other types of data together with frequency-domain data in a frequency-domain data container.

Figure 5:
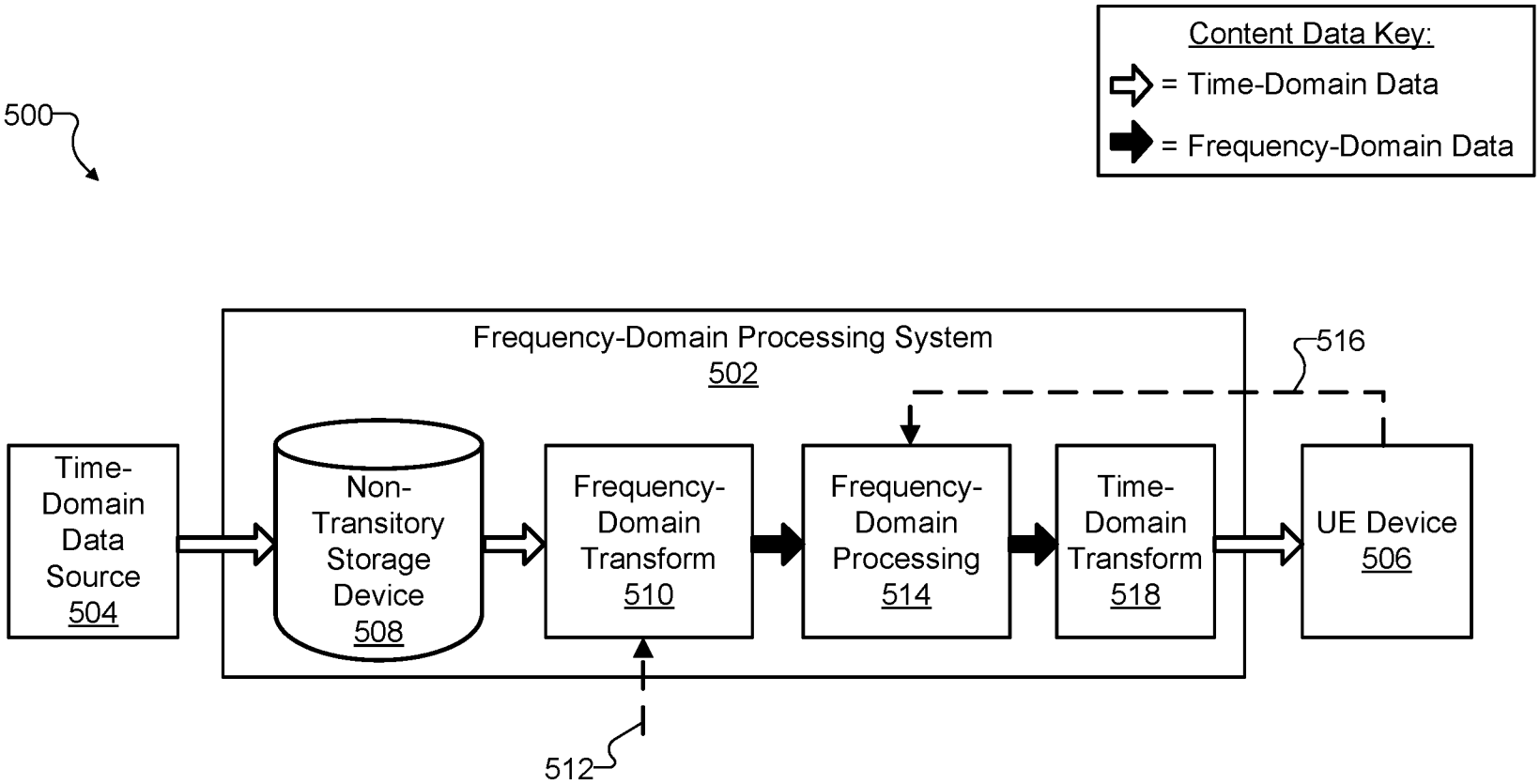
FIG. 5 illustrates an exemplary configuration for transforming time-domain data on-demand in order to process content in the frequency domain according to principles described herein.
Figure 6:
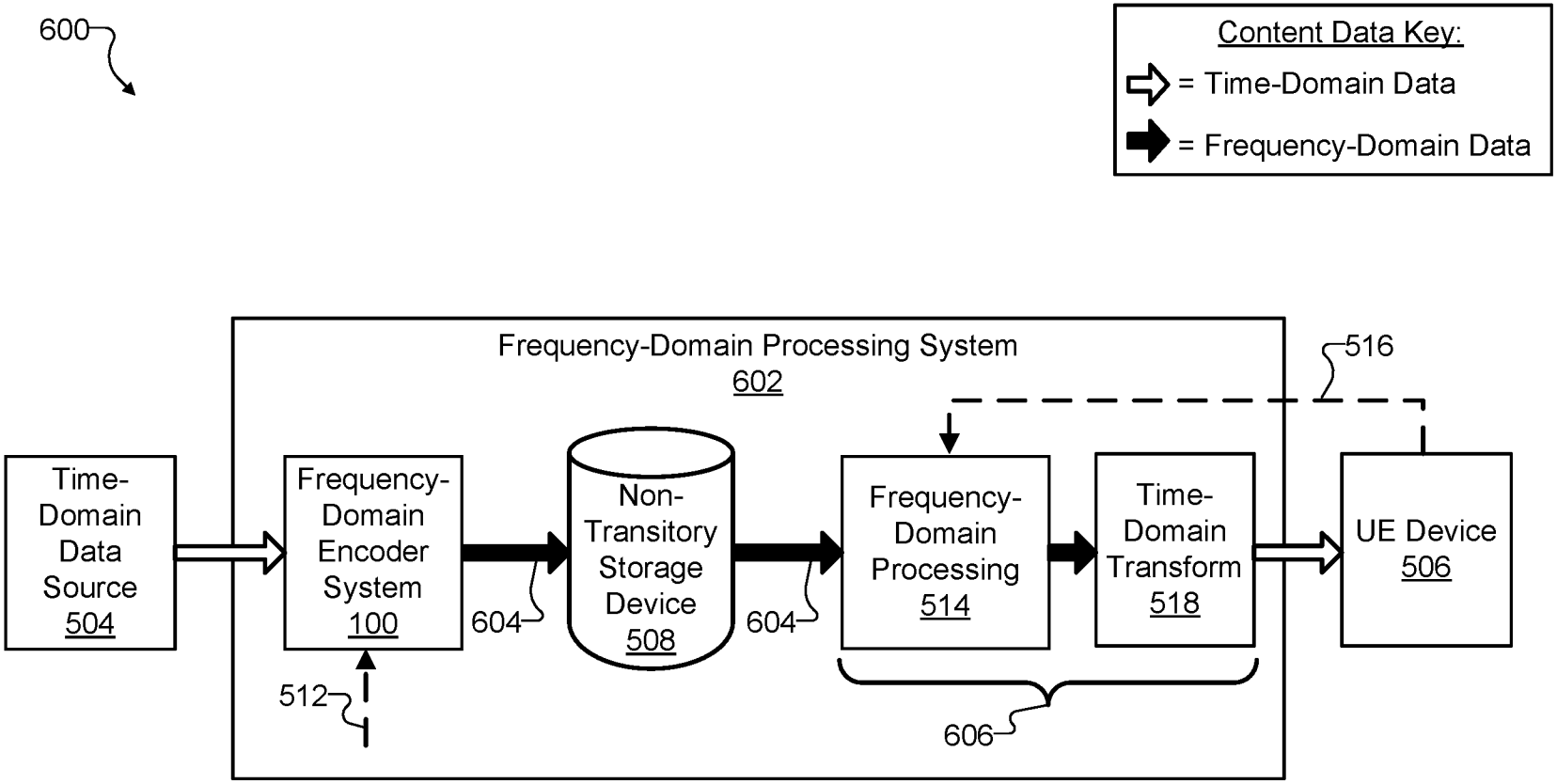
FIG. 6 illustrates an exemplary configuration in which the frequency-domain encoder system of FIG. 1 encodes frequency-domain data to avoid on-demand transforming of time-domain data when processing content in the frequency domain according to principles described herein.
Figure 7:
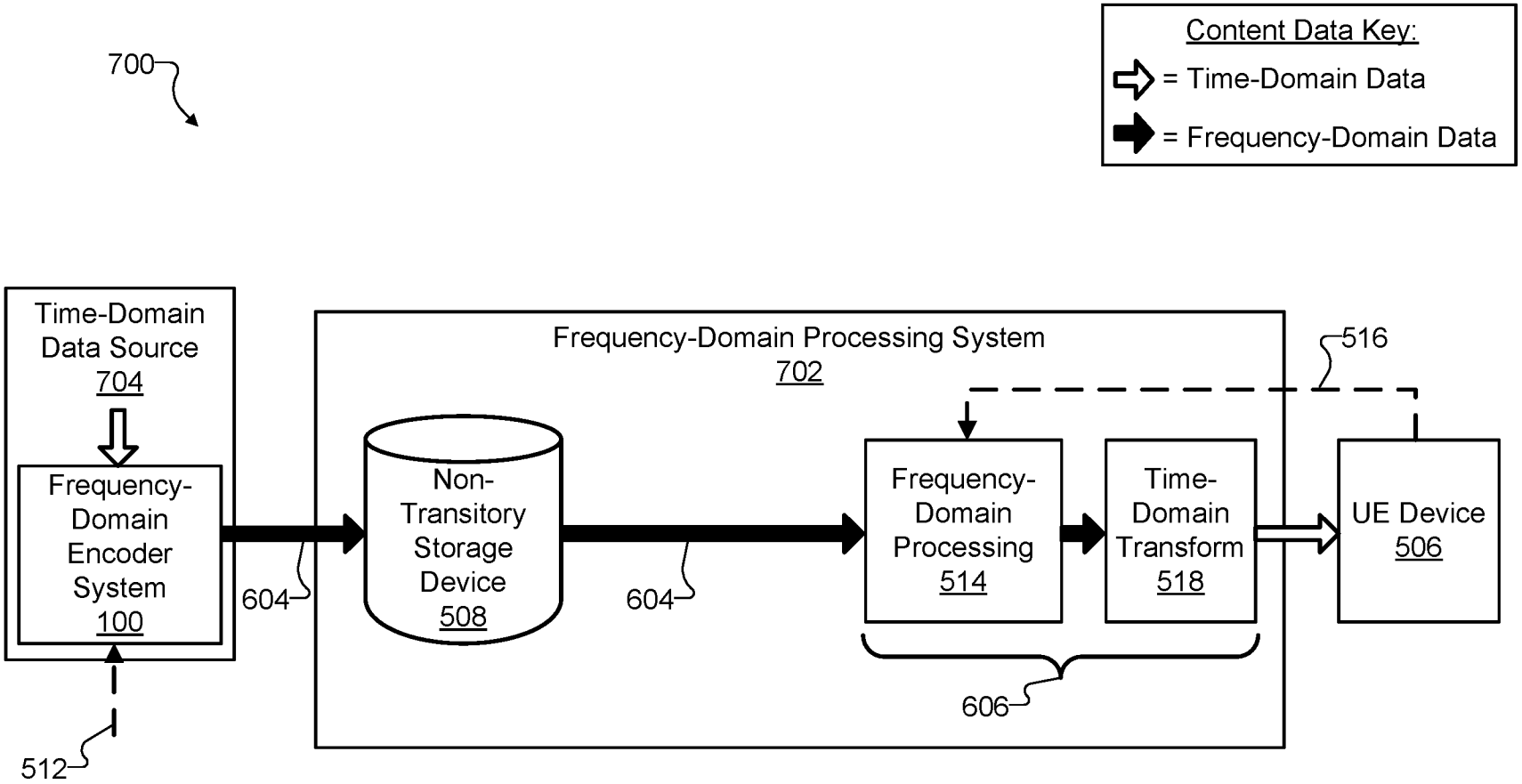
FIG. 7 illustrates another exemplary configuration in which the frequency-domain encoder system of FIG. 1 encodes frequency-domain data to avoid on-demand transforming of time-domain data when processing content in the frequency domain according to principles described herein.

FIGS. 5-7 will now be described to illustrate how a frequency-domain encoder system such as system 100 may provide benefit to particular applications and use cases, as well as to illustrate different configurations in which such a frequency-domain encoder system may be employed. Specifically, FIG. 5 shows an exemplary configuration 500 for transforming time-domain data on-demand in order to process content in the frequency domain without necessarily using a frequency-domain encoder system such as system 100 to generate a frequency-domain data container for the frequency-domain data. FIGS. 6 and 7 illustrate how a frequency-domain encoder system such as system 100 may be employed to improve on the scenario of FIG. 5 in different ways. More specifically, FIGS. 6 and 7 show different configurations 600 and 700, respectively, in which system 100 encodes frequency-domain data to avoid on-demand transforming of time-domain data when processing content in the frequency domain.

In the following description of configurations 500, 600, and 700, similar numbering will be used to refer to similar components in each configuration. For example, certain components with identical numbers appear in each of configurations 500, 600, and 700 to indicate that these components may be implemented in the same way for each configuration and are not necessarily affected by whether or how system 100 is implemented in a given implementation. Other components may use similar numbers (e.g., starting with "5," "6," or "7" depending on the configuration but otherwise remaining the same in each configuration) to indicate that these components are configured to accomplish essentially the same task as corresponding components in other configurations, but perform the task in a different manner or have other significant distinctions from configuration to configuration.

For each of configurations 500, 600, and 700, a "Content Data Key" is provided in the corner of each respective figure. As shown, unshaded (hollow) arrows represent time-domain content data passed from one component to another while shaded (filled-in) arrows represent frequency-domain content data passed from one component to another. While not shown in the content data key, it will be understood that other types of data other than content data may also be shared, passed, transmitted, or otherwise accessed by components of configurations 500, 600, and/or 700. Where explicitly illustrated, this data is depicted using a different style of arrow than the content data (e.g., an arrow with a dashed line).

As mentioned above, various different types of applications and use cases may be served by frequency-domain data containers generated by frequency-domain encoder systems and methods described herein (e.g., system 100). For example, an instance (e.g., file, stream, etc.) of any suitable type of content such as audio content, video content, image content, or other general time series content may be served by systems and methods described herein when configured in a particular way. In order to provide a more concrete use case example, reference will be made in the following description of FIGS. 5-7 to an example in which immersive audio for an extended reality world (e.g., a virtual reality world, an augmented reality world, etc.) is provided by a frequency-domain processing system to a user equipment device ("UE device") such as a media player device configured to present the extended reality world. Specifically, it will be assumed for the purposes of FIGS. 5-7 that the content instance being processed is an instance of audio data that is to be included within a simulated sound presented to a user experiencing an extended reality world by way of a media player device. As such, in the examples of configurations 600 and 700, it will be shown that system 100 may provide, to a frequency-domain processing system, the generated frequency-domain data container for frequency-domain processing by the frequency-domain processing system to generate the simulated sound for presentation to the user by way of the media player device. Each of configurations 500, 600, and 700 will now be described in more detail.

Referring to FIG. 5, configuration 500 is shown to include a frequency-domain processing system 502 that is communicatively coupled to a time-domain data source 504 from which frequency-domain processing system 502 receives an audio content instance that is to be processed, and that is further communicatively coupled with a UE device 506 to which frequency-domain processing system 502 provides processed audio data. For example, frequency-domain processing system 502 may be configured to access various audio content instances that are to be presented to a user while experiencing an extended reality world. More particularly, frequency-domain processing system 502 may process the audio content instances to simulate propagation of virtual sound through the extended reality world to left and right ears of the user's avatar in a manner that accounts for interaural time differences ("ITDs"), interaural level differences ("ILDs"), environmental sound propagation effects (e.g., acoustic reverberation, acoustic reflection, acoustic absorption, etc.), and so forth to provide a realistic and immersive audio mix for presentation to the user that will be referred to herein as a composite binaural audio stream.

To this end, time-domain data source 504 may represent a sound source that generates or originates the real sound upon which the virtual sounds originating from virtual sound sources within an extended reality world are based. While only one time-domain data source 504 is shown to be providing a single time-domain sound, it will be understood that frequency-domain processing system 502 may access various sounds from time-domain data source 504 and/or from a variety of other time-domain data sources similar to time-domain data source 504. For instance, one exemplary time-domain data source 504 may be a real-world microphone capturing speech (e.g., provided as part of a chat feature between users jointly experiencing the extended reality world) from a user of UE device 506. Another exemplary time-domain data source 504 may be a physical medium (e.g., a read-only-memory ("ROM") disc medium, a flash drive, a game cartridge, etc.) that includes data representative of the extended reality world and various sounds that may be included therein, or an extended reality experience provider system configured to transmit such data over a network.

Other exemplary time-domain data sources 504 may include a telephonic system that provides telephonic speech data as the user engages in a telephone conversation, a speech synthesis system that generates speech and other sounds associated with an intelligent assistant accessible within the extended reality world, and so forth for any other live-captured, prerecorded, or synthesized sound sources as may serve a particular implementation. Still other examples may include a music playback system, an audio content provider system (e.g., associated with an online music service, a radio station broadcast, etc.), or any other device capable of originating prerecorded or synthesized audio (e.g., music, announcements, narration, etc.) that may be presented in the extended reality world. Along with speech, media content, and so forth, virtual sounds provided by time-domain data source 504 may also include other sounds configured to further add to the realism and immersiveness of the extended reality world such as ambient and/or environmental noise, sound effects (e.g., Foley sounds, etc.), and so forth.

In some examples, time-domain data source 504 may be implemented as a system or device that is separate and distinct from frequency-domain processing system 502 and UE device 506. In other examples, time-domain data source 504 may be fully or partially integrated with frequency-domain processing system 502 and/or UE device 506 as may serve a particular implementation. Regardless of the manner of implementation of one or more time-domain data sources 504 providing audio content to frequency-domain processing system 502, however, certain audio content may be stored (e.g., temporarily buffered, stored for long-term use and reuse, etc.) in a non-transitory storage device 508 accessible to (e.g., included within) frequency-domain processing system 502. In this way, frequency-domain processing system 502 may have ready access to the audio content when the content is to be presented to a user experiencing the extended reality world.

For example, one exemplary audio content instance may be a music file representative of a song playing out of a virtual loudspeaker in the extended reality world. If an avatar of the user is near the virtual loudspeaker, it may be desirable for the user to hear the song playing out of the virtual loudspeaker in accordance with various acoustic aspects of virtual sound propagation that may be accounted for by frequency-domain processing system 502. For example, depending on how far away the avatar is from the virtual loudspeaker, the music may be simulated to be acoustically reverberated, reflected, absorbed, or otherwise influenced by virtual surfaces in the extended reality world that the sound encounters while virtually propagating to the virtual ears of the avatar. Various aspects of these propagation effects (e.g., reverberation, reflection, absorption, etc.) may be frequency dependent in the real world in the sense that certain frequencies may be affected by certain phenomena in different ways or to different degrees than other frequencies. As such, these effects may be simulated in a frequency-dependent manner by frequency-domain processing system 502 for purposes of the immersive extended reality world. Moreover, depending on which way the avatar's head is turned (e.g., depending on which direction the user is looking within the extended reality world), certain frequencies may be affected differently by a head-related transfer function than other frequencies as ILDs and ITDs are simulated.

Accordingly, it may be desirable to generate a dynamically-updated composite binaural audio stream that mixes together all the sounds of the world that the user should hear in a mix that is specifically tailored to the user for the current location he or she has selected for his or her avatar, for the direction he or she has turned his or her head, and so forth. To this end, as shown in FIG. 5, audio content instances may be accessed from non-transitory storage device 508 as time-domain data, transformed to the frequency-domain by a frequency-domain transform block 510 based on various transform parameters 512, and processed as frequency-domain data in a frequency domain processing block 514 in accordance with acoustic propagation data 516 (e.g., position data, head turn data, etc.). Frequency-domain processing block 514 may then provide the frequency-domain data to a time-domain transform block 518, where the frequency-domain data is transformed back to the time-domain for transmission to and rendering by UE device 506.

A great deal of complexity may be present in the soundscapes of extended reality worlds with a large number of virtual sound sources originating sounds that are to virtually propagate to an avatar and be heard by a corresponding user. Additionally, because the composite binaural audio stream ultimately provided by frequency-domain processing system 502 to UE device 506 may be dependent on dynamic data such as acoustic propagation data 516, significant processing resources may need to be dedicated to frequency-domain transform block 510, and frequency-domain processing block 514, which may each be simultaneously working with data representative of many different audio content instances. In order to provide access to sufficient resources to meet these challenges, frequency-domain processing system 502 may execute on a network-edge-deployed server such as a MEC server.

A network-edge-deployed server upon which frequency-domain processing system 502 is implemented may include one or more servers and/or other suitable computing systems or resources that may interoperate with UE device 506 with a low enough latency to allow for the real-time offloading of audio processing. For example, the network-edge-deployed server may leverage MEC technologies to enable cloud computing capabilities at the edge of a cellular network (e.g., a 5G cellular network in certain implementations, or any other suitable cellular network associated with any other generation of technology in other implementations). In certain examples, a network-edge-deployed server may be even more localized to UE device 506, such as by being implemented by computing resources on a same local area network with UE device 506 (e.g., by computing resources located within a home or office of the user of UE device 506), or the like. Because of the low-latency nature of network-edge-deployed servers such as MEC servers or the like, frequency-domain processing system 502 may be configured to receive real-time acoustic propagation data 516 (e.g., data indicating an up-to-date position and orientation of an avatar of the user within the extended reality world) and to return corresponding composite binaural audio stream data to UE device 506 with a small enough delay that the user perceives the presented audio as being instantaneously responsive to his or her actions (e.g., head turns, etc.). For instance, it may be desirable (e.g., in order for the user to have a high-quality and immersive extended reality experience in the extended reality world) for the latency of the audio processing to be small enough to result in sufficiently low-latency responsiveness to immerse the users in the extended reality world without being perceivable that the audio being presented has any delay (e.g., a latency between 20 ms to 50 ms, less than 100 ms, etc., as may be determined by a psychoacoustic analysis of one or more users).

By processing audio data and generating a real-time composite binaural audio stream on a low-latency network-edge-deployed server with plentiful processing resources, it may be possible to meet both the high processing demands and low latency demands of the type of use case described above for generating frequency-accurate acoustics for an extended reality world in accordance with real-time acoustic propagation data. Even still, it may be desirable to streamline the large amount of processing required to properly implement this and other such applications and use cases to make processing as efficient and effective as possible. One way that such streamlining may be accomplished is to avoid, particularly for content data that is generated ahead of time (e.g., before being integrated into a composite binaural audio stream for presentation to a user), superfluous transforming from one domain to another.

For instance, referring again to the content instance example described above of the song playing on the virtual loudspeaker in the extended reality world, it may be more efficient to store frequency-domain data representative of the song and to perform processing on the frequency-domain data directly, than to store (as shown in FIG. 5) time-domain data representative of the song that must be transformed by frequency-domain transform block 510 prior to processing by frequency-domain processing block 514. By providing data representative of the content instance (e.g., the song in this example) in a frequency-domain format, complex coefficients are thus immediately available for processing by frequency-domain processing block 514, thereby eliminating the need for redundant or on-demand frequency-domain transform operations. Other operations for data preparation may similarly be simplified or eliminated in this way, including data preparation operations such as decoding the time-domain data to a raw audio format such as a PCM format, and so forth. As has been described above and as will now be illustrated in more specific examples, systems and methods described herein may provide exactly these types of benefits by allowing frequency-domain data containers to be generated, transmitted, stored, and processed to eliminate the need for redundant and/or on-demand frequency-domain transformation to be done by systems such as frequency-domain processing system 502.

To illustrate, configuration 600 in FIG. 6 is shown to include a frequency-domain processing system 602 communicatively coupled to time-domain data source 504 and UE device 506, which were described above. Frequency-domain processing system 602 may be configured to perform the same function as frequency-domain processing system 502 described above, but, unlike frequency-domain processing system 502, may employ system 100 to implement at least some of the benefits thereof that have been described. Specifically, like frequency-domain processing system 502, frequency-domain processing system 602 may access time-domain data (e.g., data representative of one or more audio content instances) and generate time-domain data that has been processed in the frequency domain (e.g., a composite binaural audio stream that accounts for frequency-accurate acoustics for an extended reality world) without the same redundant and on-demand frequency-domain transformations described in relation to configuration 500.

As shown, system 100 may be implemented within frequency-domain processing system 602 (e.g., executing on a network-edge-deployed server such as a MEC server or the like), and may access time-domain data representative of a content instance from time-domain data source 504. System 100 may also access similar or the same transfer parameters 512 described above, which may be included as part of a set of encoder parameters such as the set of encoder parameters 202 described in relation to FIG. 2. As described above, system 100 may generate a frequency-domain data container that includes, in a predefined data container format, the complex coefficients of frequency-domain data and metadata descriptive of frequency-domain data representative of the content instance provided by time-domain data source 504. Specifically, as shown in configuration 600, this frequency-domain data container is labeled as frequency-domain data container 604 and will be understood to be similar to any of the implementations of frequency-domain data container 206 described herein. As shown, frequency-domain data container 604 is stored by non-transitory storage device 508.

By storing frequency-domain data container 604 rather than time-domain data (as was stored in configuration 500), non-transitory storage device 508 may provide frequency-domain data to frequency-domain processing block 514 directly, rather than the stored data needing to first be processed through frequency-domain transform block 510 as described above in relation to configuration 500. The efficiency gained by this may be minimal for certain content instances that are only to be processed once and/or need to be processed immediately (e.g., real-time chat content that is spoken by one user and is to be presented immediately to another user of an extended reality world). This is because the frequency-domain transformation of transformation block 510 is essentially still performed within system 100, as described above.

The advantages gained, however, for other content instances that may be processed multiple times and/or are defined ahead of time are very significant. For example, instead of transforming the same audio content instance (e.g., media content such as a song, a sound effect, audio associated with non-player character dialog, narration, etc.) to the frequency-domain repeatedly for every usage such as would be required by transformation block 510 shown in configuration 500, system 100 may perform a time-to-frequency-domain transformation just once and may store the results (e.g., in the form of frequency-domain data container 604) for any number of later usages as might be needed. Additionally, if the time-domain data (e.g., the audio content instance in this example) is known prior to when the processed data is to be provided to UE device 506 (e.g., prior to when the audio is to be presented to the user during the extended reality experience in this example), the relatively processing-intensive domain transformation operation may be done in a way and at a pace that is efficient and convenient based on what resources are available, rather than needing to be performed immediately in a possibly less efficient way to meet latency targets. In this way, frequency-domain processing system 602 may not require the same degree of computing power as frequency-domain processing system 602, which may be required to consistently perform domain transformation operations dynamically, on-demand, and with low latency. Computing resources of frequency-domain processing system 602 may thus be used in a more efficient manner than the computing resources of frequency-domain processing system 502, described above.

As labeled in FIG. 6, frequency-domain processing block 514 and time-domain transform block 518 may collectively implement, include, be implemented within, or otherwise be associated with a dual-layer decoder 606. Dual-layer decoder 606 may perform two types of decoding in order to convert frequency-domain data container 604 into time-domain data that may be processed and eventually used (e.g., rendered, etc.) by UE device 506. Specifically, dual-layer decoder 606 may be configured first to perform standard decoding and decompression operations to convert frequency-domain data container 604 into raw complex coefficients and/or other associated data. In some examples, this first layer of decoding may involve unpacking data in accordance with the blocking scheme of frequency-domain data container 604 and/or other such operations as may serve a particular implementation. Once raw frequency-domain data has been derived from frequency-domain data container 604, dual-layer decoder 606 may perform a second type of decoding that involves transforming the raw complex coefficients of the frequency-domain data back into time-domain data that is usable (e.g., renderable) by UE device 506. For example, this second type of decoding may include overlap and add ("OLA") operations, parsing zero padding, and so forth. In between these two types of decoding, any suitable processing (e.g., acoustic effects processing, etc.) may be performed as may serve a particular implementation.

While dual-layer decoder 606 is shown to be implemented in frequency-domain processing system 602 in FIG. 6, it will be understood that dual-layer decoder 606 may be implemented within UE device 506 in certain implementations such that frequency-domain data container 604, rather than the time-domain data itself, may be transmitted from frequency-domain processing system 602 to UE device 506. For example, frequency-domain data container 604 may be transmitted over a network not explicitly shown in configuration 600.

Configuration 600 illustrates that system 100 may be implemented within frequency-domain processing system 602 to prepare a file that may be stored for a later time when the file is needed, whereupon the file may be used and reused without redundant time-to-frequency-domain transformations. Specifically, frequency-domain data container 604 may be a frequency-domain data file in this example and system 100 may provide (e.g., in response to generating frequency-domain data container 604) the frequency-domain data file to non-transitory storage device 508, which is configured to store the frequency-domain data file to be accessed by frequency-domain processing system 602 at a future time. In the same or other examples, however, it will be understood that frequency-domain data container 604 may be implemented as other types of containers or used in different ways. For example, frequency-domain data container 604 may, in certain examples, be implemented as a frequency-domain data stream, and system 100 may provide (e.g., in response to the generating of frequency-domain data container 604) the frequency-domain data stream to a communication network configured to transmit the frequency-domain data stream from system 100 to a frequency-domain processing system configured to receive the frequency-domain data stream (e.g., such as frequency-domain processing system 602).

To illustrate, configuration 700 of FIG. 7 shows an example in which system 100 is included within a time-domain data source 704 that may serve a similar role as time-domain data source 504, but, as shown, may provide frequency-domain data container 604 to a frequency-domain processing system 702 directly, rather than providing time-domain data as shown in configurations 500 and 600. As shown by the time-domain data arrow in time-domain data source 704, time-domain data source 704 may still record, access, generate, or otherwise provide content instances represented in the time domain. However, rather than providing time-domain data to frequency-domain processing system 702, time-domain data source 704 includes an implementation of system 100 that generates and provides frequency-domain data container 604.

In configuration 700, the frequency-domain data container 604 transmitted by system 100 to frequency-domain processing system 702 may be understood to be a frequency-domain data stream such as described above. This formatting may facilitate the transmission of frequency-domain data container 604.

Like frequency-domain processing system 602 in configuration 600, configuration 700 includes frequency-domain processing system 702 that includes non-transitory storage device 508 that may store frequency-domain data container 604. Once frequency-domain data container 604 is streamed to frequency-domain processing system 702, frequency-domain data container 604 may be used directly as it is streaming in, or stored as a frequency-domain data stream in a similar manner as described above in relation to FIG. 6. In either case, the same benefits may accrue to configuration 700 as described above for configuration 600 when frequency-domain data container 604 is provided for frequency-domain processing at block 514 without need for additional, on-demand, and/or redundant time-to-frequency-domain transformation operations.

Figure 8:
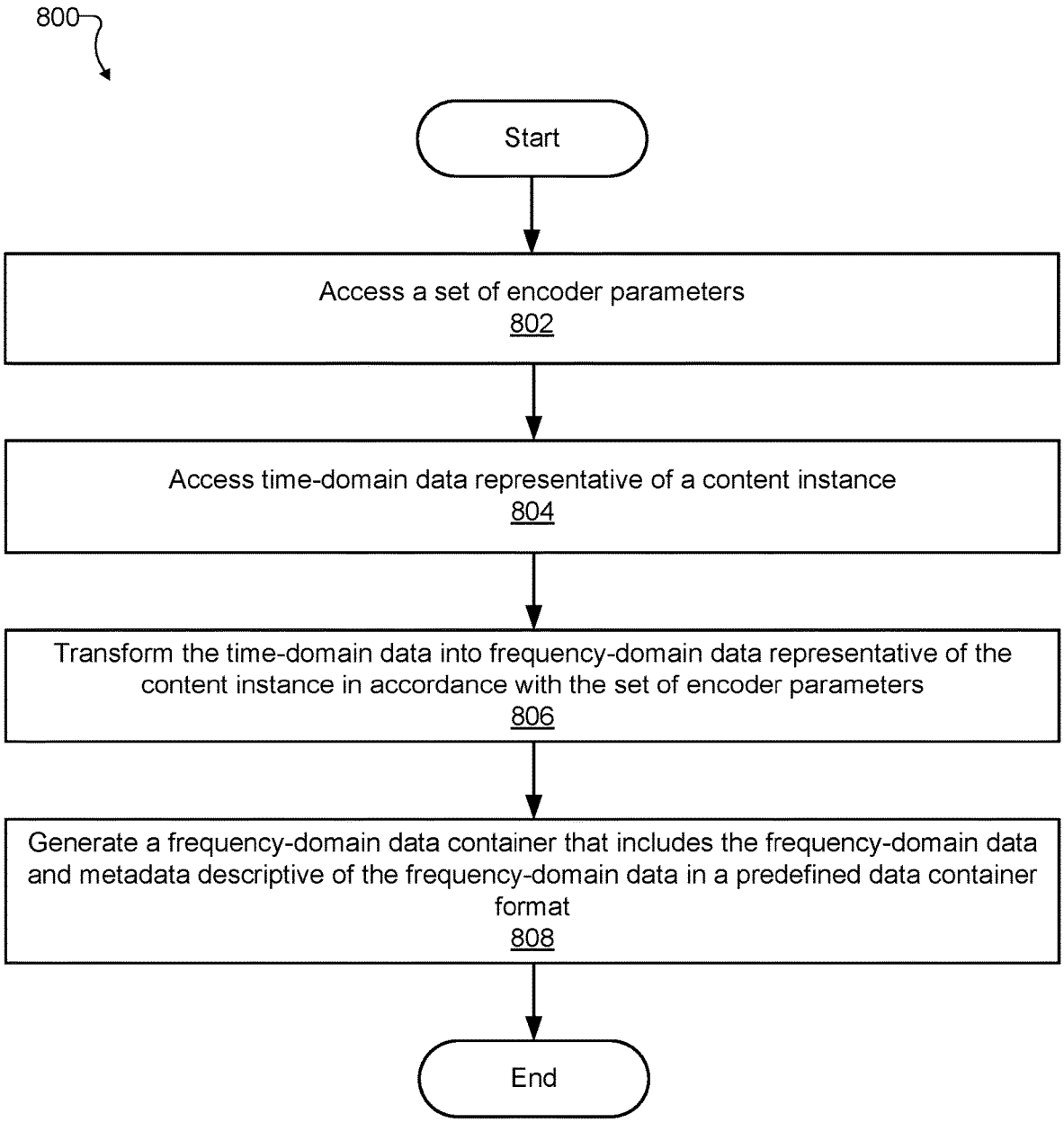
FIG. 8 illustrates an exemplary method for encoding frequency-domain data according to principles described herein.

FIG. 8 illustrates an exemplary method 800 for encoding frequency-domain data. While FIG. 8 illustrates exemplary operations according to one embodiment, other embodiments may omit, add to, reorder, and/or modify any of the operations shown in FIG. 8. One or more of the operations shown in FIG. 8 may be performed by system 100, any components included therein, and/or any implementation thereof.

In operation 802, a frequency-domain encoder system may access a set of encoder parameters including any of the encoder parameters described herein. Operation 802 may be performed in any of the ways described herein.

In operation 804, the frequency-domain encoder system may access time-domain data representative of a content instance of any of the types of content instances described herein. Operation 804 may be performed in any of the ways described herein.

In operation 806, the frequency-domain encoder system may transform the time-domain data into frequency-domain data representative of the content instance. For example, the frequency-domain encoder system may transform the time-domain data into the frequency-domain data in accordance with the set of encoder parameters accessed in operation 802. In some examples, the frequency-domain data may include a plurality of complex coefficients each representing different frequency components of a plurality of frequency components incorporated by the content instance accessed in operation 804. Operation 806 may be performed in any of the ways described herein.

In operation 808, the frequency-domain encoder system may generate a frequency-domain data container. For example, the frequency-domain data container may include, in a predefined data container format, the complex coefficients of the frequency-domain data and metadata descriptive of the frequency-domain data. In some examples, the generating of the frequency-domain data container may be performed in accordance with the set of encoder parameters accessed in operation 802. Operation 808 may be performed in any of the ways described herein.

In certain embodiments, one or more of the systems, components, and/or processes described herein may be implemented and/or performed by one or more appropriately configured computing devices. To this end, one or more of the systems and/or components described above may include or be implemented by any computer hardware and/or computer-implemented instructions (e.g., software) embodied on at least one non-transitory computer-readable medium configured to perform one or more of the processes described herein. In particular, system components may be implemented on one physical computing device or may be implemented on more than one physical computing device. Accordingly, system components may include any number of computing devices, and may employ any of a number of computer operating systems.

In certain embodiments, one or more of the processes described herein may be implemented at least in part as instructions embodied in a non-transitory computer-readable medium and executable by one or more computing devices. In general, a processor (e.g., a microprocessor) receives instructions, from a non-transitory computer-readable medium, (e.g., a memory, etc.), and executes those instructions, thereby performing one or more processes, including one or more of the processes described herein. Such instructions may be stored and/or transmitted using any of a variety of known computer-readable media.

A computer-readable medium (also referred to as a processor-readable medium) includes any non-transitory medium that participates in providing data (e.g., instructions) that may be read by a computer (e.g., by a processor of a computer). Such a medium may take many forms, including, but not limited to, non-volatile media, and/or volatile media. Non-volatile media may include, for example, optical or magnetic disks and other persistent memory. Volatile media may include, for example, dynamic random access memory ("DRAM"), which typically constitutes a main memory. Common forms of computer-readable media include, for example, a disk, hard disk, magnetic tape, any other magnetic medium, a compact disc read-only memory ("CD-ROM"), a digital video disc ("DVD"), any other optical medium, random access memory ("RAM"), programmable read-only memory ("PROM"), electrically erasable programmable read-only memory ("EPROM"), FLASH-EEPROM, any other memory chip or cartridge, or any other tangible medium from which a computer can read.

Figure 9:
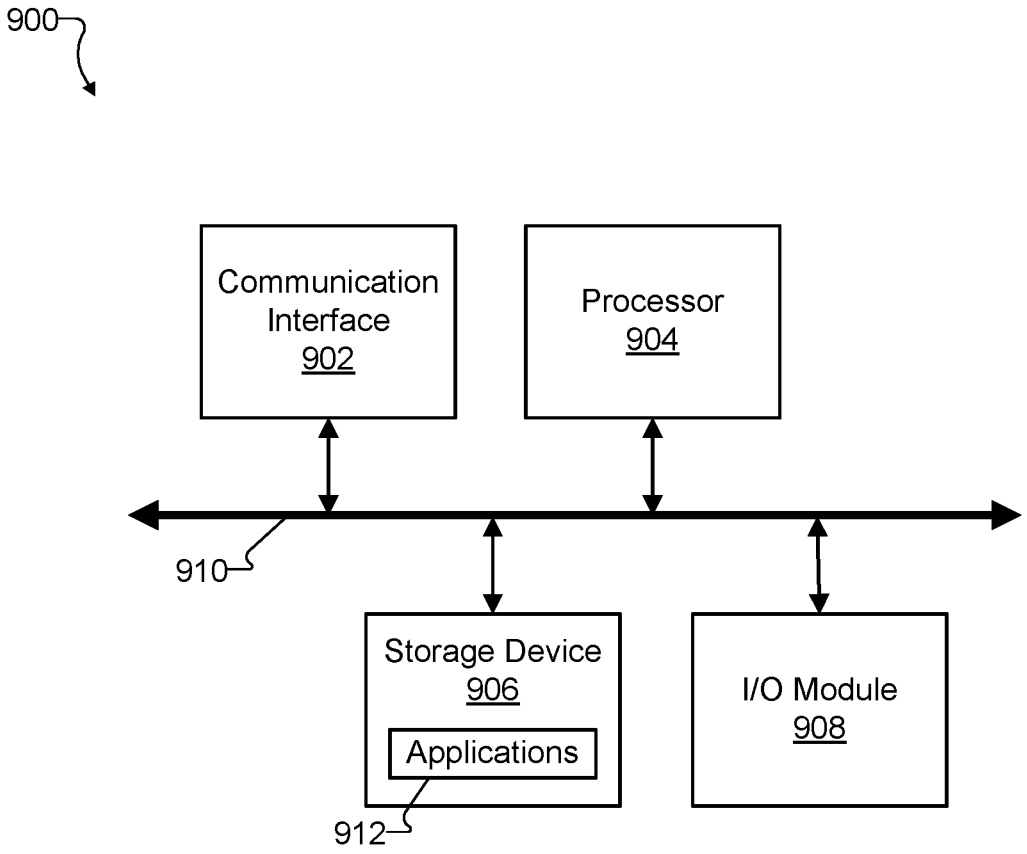
FIG. 9 illustrates an exemplary computing device according to principles described herein.

FIG. 9 illustrates an exemplary computing device 900 that may be specifically configured to perform one or more of the processes described herein. As shown in FIG. 9, computing device 900 may include a communication interface 902, a processor 904, a storage device 906, and an input/output ("I/O") module 908 communicatively connected via a communication infrastructure 910. While an exemplary computing device 900 is shown in FIG. 9, the components illustrated in FIG. 9 are not intended to be limiting. Additional or alternative components may be used in other embodiments. Components of computing device 900 shown in FIG. 9 will now be described in additional detail.

Communication interface 902 may be configured to communicate with one or more computing devices. Examples of communication interface 902 include, without limitation, a wired network interface (such as a network interface card), a wireless network interface (such as a wireless network interface card), a modem, an audio/video connection, and any other suitable interface.

Processor 904 generally represents any type or form of processing unit capable of processing data or interpreting, executing, and/or directing execution of one or more of the instructions, processes, and/or operations described herein. Processor 904 may direct execution of operations in accordance with one or more applications 912 or other computer-executable instructions such as may be stored in storage device 906 or another computer-readable medium.

Storage device 906 may include one or more data storage media, devices, or configurations and may employ any type, form, and combination of data storage media and/or device. For example, storage device 906 may include, but is not limited to, a hard drive, network drive, flash drive, magnetic disc, optical disc, RAM, dynamic RAM, other non-volatile and/or volatile data storage units, or a combination or sub-combination thereof. Electronic data, including data described herein, may be temporarily and/or permanently stored in storage device 906. For example, data representative of one or more executable applications 912 configured to direct processor 904 to perform any of the operations described herein may be stored within storage device 906. In some examples, data may be arranged in one or more databases residing within storage device 906.

I/O module 908 may include one or more I/O modules configured to receive user input and provide user output. One or more I/O modules may be used to receive input for a single virtual experience. I/O module 908 may include any hardware, firmware, software, or combination thereof supportive of input and output capabilities. For example, I/O module 908 may include hardware and/or software for capturing user input, including, but not limited to, a keyboard or keypad, a touchscreen component (e.g., touchscreen display), a receiver (e.g., an RF or infrared receiver), motion sensors, and/or one or more input buttons.

I/O module 908 may include one or more devices for presenting output to a user, including, but not limited to, a graphics engine, a display (e.g., a display screen), one or more output drivers (e.g., display drivers), one or more audio speakers, and one or more audio drivers. In certain embodiments, I/O module 908 is configured to provide graphical data to a display for presentation to a user. The graphical data may be representative of one or more graphical user interfaces and/or any other graphical content as may serve a particular implementation.

In some examples, any of the facilities described herein may be implemented by or within one or more components of computing device 900. For example, one or more applications 912 residing within storage device 906 may be configured to direct processor 904 to perform one or more processes or functions associated with processing facility 104 of system 100. Likewise, storage facility 102 of system 100 may be implemented by or within storage device 906.

To the extent the aforementioned embodiments collect, store, and/or employ personal information provided by individuals, it should be understood that such information shall be used in accordance with all applicable laws concerning protection of personal information. Additionally, the collection, storage, and use of such information may be subject to consent of the individual to such activity, for example, through well known "opt-in" or "opt-out" processes as may be appropriate for the situation and type of information. Storage and use of personal information may be in an appropriately secure manner reflective of the type of information, for example, through various encryption and anonymization techniques for particularly sensitive information.

In the preceding description, various exemplary embodiments have been described with reference to the accompanying drawings. It will, however, be evident that various modifications and changes may be made thereto, and additional embodiments may be implemented, without departing from the scope of the invention as set forth in the claims that follow. For example, certain features of one embodiment described herein may be combined with or substituted for features of another embodiment described herein. The description and drawings are accordingly to be regarded in an illustrative rather than a restrictive sense.

What is claimed is:

1. A method comprising:

transforming, by a frequency-domain encoder system, time-domain data representative of a content instance into frequency-domain data representative of the content instance, the frequency-domain data including a plurality of complex coefficients each representing different frequency components of a plurality of frequency components incorporated by the content instance;

generating, by the frequency-domain encoder system, a frequency-domain data container that includes the complex coefficients of the frequency-domain data and metadata descriptive of the frequency-domain data; and integrating, by the frequency-domain encoder system and within the frequency-domain data container, the complex coefficients of the frequency-domain data with timing data representative of a time-dependent feature of the content instance.

2. The method of claim 1, wherein the timing data representative of the time-dependent feature of the content instance includes one or more of:

time code information associated with the content instance;

phoneme or viseme data associated with an animation implemented by the content instance;

motion capture data associated with the content instance; or video information or graphical asset data associated with the content instance.

3. The method of claim 1, wherein the complex coefficients and the metadata are included in the frequency-domain data container in a predefined data container format that designates:

a metadata portion of the frequency-domain data container to contain, formatted in a plurality of predetermined metadata fields, the metadata descriptive of the frequency-domain data; and a payload portion of the frequency-domain data container to contain, formatted in a predetermined blocking format, the complex coefficients of the frequency-domain data.

4. The method of claim 3, wherein the plurality of predetermined metadata fields used for the metadata portion of the frequency-domain data container include at least one of:

a first metadata field designated for blocking data indicating a respective size and type of each of a plurality of data blocks that are included within the payload portion of the frequency-domain data container;

a second metadata field designated for a transmission error signature;

a third metadata field designated for indicating a compression algorithm used to compress the payload portion of the frequency-domain data container;

a fourth metadata field designated for indicating a variable bitrate implementation used to transmit the frequency-domain data container; or a fifth metadata field designated for frequency-domain parameters used to transform the time-domain data into the frequency-domain data.

5. The method of claim 1, wherein the generating of the frequency-domain data container includes alternating, within a payload portion of the frequency-domain data container:

a first plurality of payload segments each including a different portion of the complex coefficients of the frequency-domain data, with a second plurality of payload segments each including a portion of the time-domain data that corresponds to one of the different portions of the complex coefficients of the frequency-domain data.

6. The method of claim 1, further comprising:

accessing, by the frequency-domain encoder system prior to the transforming, the time-domain data representative of the content instance and a set of encoder parameters;

wherein the transforming of the time-domain data and the generating of the frequency-domain data container are each performed in accordance with the set of encoder parameters.

7. The method of claim 6, wherein the generating of the frequency-domain data container comprises:

selecting, based on the set of encoder parameters, a compression algorithm from a set of compression algorithms;

compressing, using the selected compression algorithm, the complex coefficients of the frequency-domain data; and integrating the compressed complex coefficients of the frequency-domain data into the frequency-domain data container.

8. The method of claim 6, wherein:

the set of encoder parameters includes fast Fourier transform ("FFT") parameters; and the transforming of the time-domain data into the frequency-domain data is performed using an FFT technique based on the FFT parameters.

9. The method of claim 1, wherein:

the frequency-domain data container is a frequency-domain data file; and the method further comprises providing, by the frequency-domain encoder system based on the generating and the integrating, the frequency-domain data file to a non-transitory storage device that is configured to store the frequency-domain data file to be accessed by a frequency-domain processing system at a future time.

10. The method of claim 1, wherein:

the frequency-domain data container is a frequency-domain data stream; and the method further comprises providing, by the frequency-domain encoder system based on the generating and the integrating, the frequency-domain data stream to a communication network configured to transmit the frequency-domain data stream from the frequency-domain encoder system to a frequency-domain processing system configured to receive the frequency-domain data stream.

11. The method of claim 1, wherein:

the content instance is an instance of audio data that is to be included within a simulated sound presented as part of an extended reality experience provided by a media player device; and the method further comprises providing, by the frequency-domain encoder system to a frequency-domain processing system, the frequency-domain data container for frequency-domain processing by the frequency-domain processing system to generate the simulated sound for presentation by the media player device.

12. A system comprising:

a memory storing instructions; and a processor communicatively coupled to the memory and configured to execute the instructions to:

transform time-domain data representative of a content instance into frequency-domain data representative of the content instance, the frequency-domain data including a plurality of complex coefficients each representing different frequency components of a plurality of frequency components incorporated by the content instance;

generate a frequency-domain data container that includes the complex coefficients of the frequency-domain data and metadata descriptive of the frequency-domain data; and integrate, within the frequency-domain data container, the complex coefficients of the frequency-domain data with timing data representative of a time-dependent feature of the content instance.

13. The system of claim 12, wherein the timing data representative of the time-dependent feature of the content instance includes one or more of:

time code information associated with the content instance;

phoneme or viseme data associated with an animation implemented by the content instance;

motion capture data associated with the content instance; or video information or graphical asset data associated with the content instance.

14. The system of claim 12, wherein the complex coefficients and the metadata are included in the frequency-domain data container in a predefined data container format that designates:

a metadata portion of the frequency-domain data container to contain, formatted in a plurality of predetermined metadata fields, the metadata descriptive of the frequency-domain data; and a payload portion of the frequency-domain data container to contain, formatted in a predetermined blocking format, the complex coefficients of the frequency-domain data.

15. The system of claim 12, wherein the generating of the frequency-domain data container includes alternating, within a payload portion of the frequency-domain data container:

a first plurality of payload segments each including a different portion of the complex coefficients of the frequency-domain data, with a second plurality of payload segments each including a portion of the time-domain data that corresponds to one of the different portions of the complex coefficients of the frequency-domain data.

16. The system of claim 12, wherein:

the processor is further configured to execute the instructions to access, prior to the transforming, the time-domain data representative of the content instance and a set of encoder parameters; and the transforming of the time-domain data and the generating of the frequency-domain data container are each performed in accordance with the set of encoder parameters.

17. The system of claim 16, wherein the generating of the frequency-domain data container comprises:

selecting, based on the set of encoder parameters, a compression algorithm from a set of compression algorithms;

compressing, using the selected compression algorithm, the complex coefficients of the frequency-domain data; and integrating the compressed complex coefficients of the frequency-domain data into the frequency-domain data container.

18. The system of claim 12, wherein:

the frequency-domain data container is a frequency-domain data file; and the processor is further configured to execute the instructions to provide, based on the generating and the integrating, the frequency-domain data file to a non-transitory storage device that is configured to store the frequency-domain data file to be accessed by a frequency-domain processing system at a future time.

19. The system of claim 12, wherein:

the frequency-domain data container is a frequency-domain data stream; and the processor is further configured to execute the instructions to provide, based on the generating and the integrating, the frequency-domain data stream to a communication network configured to transmit the frequency-domain data stream from the system to a separate system configured to receive and process the frequency-domain data stream.

20. A non-transitory computer-readable medium storing instructions that, when executed, direct a processor of a computing device to:

transform time-domain data representative of a content instance into frequency-domain data representative of the content instance, the frequency-domain data including a plurality of complex coefficients each representing different frequency components of a plurality of frequency components incorporated by the content instance;

generate a frequency-domain data container that includes the complex coefficients of the frequency-domain data and metadata descriptive of the frequency-domain data; and integrate, within the frequency-domain data container, the complex coefficients of the frequency-domain data with timing data representative of a time-dependent feature of the content instance.

* * * * *